US007870735B2

(12) United States Patent
Romanelli et al.

(10) Patent No.: US 7,870,735 B2
(45) Date of Patent: Jan. 18, 2011

(54) CLOSED LOOP EXPANDABLE GAS CIRCUIT FOR POWER GENERATION

(75) Inventors: Pat Romanelli, Harrington Park, NJ (US); Robert J. Romanelli, Savannah, GA (US)

(73) Assignee: Romanelli Energy Systems, L.L.C., Cream Ridge, NJ (US)

( * ) Notice: Subject to any disclaimer, the term of this patent is extended or adjusted under 35 U.S.C. 154(b) by 687 days.

(21) Appl. No.: 11/683,101

(22) Filed: Mar. 7, 2007

(65) Prior Publication Data

US 2008/0216479 A1 Sep. 11, 2008

(51) Int. Cl.
*F01K 7/34* (2006.01)

(52) U.S. Cl. ..... 60/653; 60/677; 60/679

(58) Field of Classification Search ..... 60/653, 60/677–679, 706, 716, 719
See application file for complete search history.

(56) References Cited

U.S. PATENT DOCUMENTS

| | | | | | |
|---|---|---|---|---|---|
| 2,844,004 | A * | 7/1958 | Vogler | 60/679 |
| 3,016,712 | A * | 1/1962 | Taylor | 60/676 |
| 3,946,560 | A * | 3/1976 | MacIntosh et al. | 60/421 |
| 4,086,772 | A | 5/1978 | Williams | 60/651 |
| 4,170,116 | A | 10/1979 | Williams | 62/116 |
| 4,698,973 | A | 10/1987 | Johnston | 60/670 |
| 4,805,410 | A | 2/1989 | Johnston | 60/671 |
| 6,035,642 | A * | 3/2000 | Peletz et al. | 60/649 |
| 6,105,369 | A * | 8/2000 | Peletz, Jr. | 60/649 |
| 6,125,634 | A * | 10/2000 | Wittchow | 60/678 |
| 6,301,895 | B1 * | 10/2001 | Kallina et al. | 60/653 |
| 6,397,600 | B1 | 6/2002 | Romanelli | 60/671 |
| 6,594,997 | B2 | 7/2003 | Romanelli | 60/651 |
| 6,817,181 | B2 * | 11/2004 | Andersson | 60/651 |
| 2006/0059912 | A1 | 3/2006 | Romanelli et al. | 60/645 |

* cited by examiner

*Primary Examiner*—Hoang M Nguyen
(74) *Attorney, Agent, or Firm*—Winston & Strawn LLP

(57) ABSTRACT

The invention relates to an apparatus that includes a first heat exchanger for heating a first heat transfer medium in a first form from a first temperature to a second higher temperature to provide an increased pressure gas, a first mechanical device configured to use the increased pressure gas to provide mechanical energy to one or more primary components, and one or more additional mechanical devices configured to use the increased pressure gas to provide mechanical energy to one or more secondary components. The mechanical device produces spent gas, and a conversion device is operably associated with at least one of the mechanical devices to convert the spent gas to the first form for re-use. A method is also disclosed for efficiently generating mechanical or electrical energy by heating a first heat transfer medium which is an expandable gas having a boiling point which is below the freezing point of water from a first temperature to a second higher temperature to provide an increased pressure gas; utilizing the increased pressure gas to provide mechanical energy, thus forming a spent gas; and recycling the spent gas to the heating step for re-use as the heat transfer medium expandable gas.

23 Claims, 11 Drawing Sheets

CLOSED LOOP EXPANDABLE GAS CIRCUIT FOR POWER GENERATION

TECHNICAL FIELD

The invention relates to the development of energy for the purpose of creating power that can be used in a variety of applications, including devices and engines for generation of electric or motive power for land, marine or air transportation, and to processes for accomplishing the same.

BACKGROUND

The present day forms of creating power are generally dependent upon the burning of fossil fuels to generate electric power. In doing so, a serious environmental problem is created in the form of air, water and land pollution. Also, in burning such fuels to create kinetic energy, thermal efficiencies are relatively inefficient due to the formation of incomplete combustion products. This results in exhaust pollution of these products, such as carbon monoxide, carbon dioxide, nitrous oxides and particulates.

Certain attempts have been made to create power without generating such pollutants. Williams U.S. Pat. Nos. 4,086,772 and 4,170,116 disclose a continuous method and closed cycle system for converting thermal energy into mechanical energy. This system comprises vaporizing means, including an energy conversion tube having a special nozzle section, for converting a liquid working fluid stream to a vapor stream. This vapor stream operates a turbine means wherein a portion of the energy of the vapor stream is converted to mechanical shaft work. This system also includes means for increasing the thermal and static energy content of the fluid stream, this means typically being pump means. The vapor fraction of that exits the turbine means passes through condensing means, such as a diffuser, to regenerate the working liquid stream. Finally, means are provided for recycling the condensed liquid stream back to the vaporizing means. The working fluid may be carbon dioxide, liquid nitrogen, or a fluorocarbon. Preferred fluorocarbons are difluoromonochloromethane, pentafluoromonochloroethane, difluorodichloromethane and mixtures and azeotropes thereof.

Johnston U.S. Pat. Nos. 4,805,410 and 4,698,973 disclose closed loop systems that recirculate a vaporizable working fluid between its liquid and vapor states in a thermodynamic working cycle. In this cycle, energy received from an external energy source is utilized to vaporize the fluid to a high pressure in a boiler unit. The resulting vapor is utilized in an energy utilizing device, such as a slidable piston which causes rotation of a crank shaft coupled to a flywheel to deliver mechanical output at a rotating shaft connected thereto. Thereafter, the vapor is condensed into a condensate at a relatively lower pressure in a condensing unit and then is returned to the boiler unit for repeating of the thermodynamic cycle. Also, the condensate flow between the condensing unit and boiler unit is collected in one of two holding tanks in selective pressure communication with the boiler unit. Preferred working fluids include water, Freon or ammonia. Also, thermal regeneration means may be included for providing regenerative heating of the working fluid.

U.S. Pat. Nos. 6,397,600 and 6,594,997, which are incorporated by reference herein, disclose a method and apparatus for efficiently generating mechanical or electrical energy. The method includes the steps of heating a vaporizable, first liquid heat transfer medium to generate a high pressure vapor; utilizing the high pressure vapor to provide mechanical energy and thereafter condensing the vapor to a liquid; and recycling the condensed liquid to the heating step for re-use as the first liquid heat transfer medium. The apparatus includes a closed loop heat transfer medium system having a first heat exchanger for heating a vaporizable, first liquid heat transfer medium to generate a high pressure vapor; a mechanical device which utilizes the high pressure vapor to provide mechanical energy; a condenser for condensing the vapor to a liquid; and piping for fluidly connecting the first heat exchanger, mechanical device and condenser, and for recycling the condensed liquid to the first heat exchanger for re-use. The first heat transfer medium is preferably maintained in a hermetically sealed circuit so that essentially no loss of heat transfer medium occurs during the heating and condensing steps, and is a fluorocarbon or fluorocarbon mixture that (a) generates a high pressure of at least 400 PSI at a pressure generation temperature that is below the boiling point of water, (b) has a boiling point which is below the freezing point of water, and (c) has a critical temperature which is above that of the pressure generation temperature.

While these prior art systems are somewhat suitable for their intended purpose, there remains a need for improvements in systems and processes for power generation, in particular for small, more efficient systems that operate at relatively low temperatures and that include engines for generating torque and power.

SUMMARY OF THE INVENTION

The invention relates to an apparatus for generating power or torque which may include a first heat exchanger for heating a first heat transfer medium in a first form from a first temperature to a second higher temperature to provide an increased pressure gas, a first mechanical device configured to use the increased pressure gas to provide mechanical energy to one or more primary components, one or more additional mechanical devices configured to use the increased pressure gas to provide mechanical energy to one or more secondary components, a plurality of conduits sized and configured to direct the increased pressure gas to at least one of the mechanical device and the one or more additional mechanical devices, and a conversion device operably associated with at least one of the first mechanical device and the one or more additional mechanical devices wherein the conversion device converting spent gas to the first form for re-use, the spent gas being produced by the first mechanical device and the one or more additional mechanical devices. In particular, it is desirable to provide a system which utilizes a first energy generator to provide energy to one or more primary components and at least one additional energy generator to provide energy to one or more secondary components so as to not divert energy from the first energy generator for secondary components.

The first heat transfer medium may be an expandable gas which has a boiling point below the freezing point of water. The expandable gas may have a critical temperature which is above that of the second temperature and, when heated to the second temperature, may provide a pressure increase of from about 1.5 to about 5 PSI per ° F. temperature increase over ambient temperature. In one embodiment, the expandable gas may be nitrous oxide. Nitrous oxide may generate a pressure of about 500 PSI at 55° F. The pressure can be increased to around 1067 PSI when the gas is heated to 94° F. In another embodiment, fluorocarbons such as, for example, AZ-20, may be used. Fluorocarbons may also generate high pressures when heated to temperatures below the boiling point of water and, generally below 190° F. Thus, heating the gas to a relatively modest warm temperature may generate an increased pressure that can be used to drive a piston or do other work to create energy. Since the apparatus may be operated at relative low temperatures, the various components of the apparatus may be made of a light weight material such as, for example, plastic.

The first heat exchanger may include a vessel for containing the first heat transfer medium. In one embodiment, the first heat exchanger may also comprise a second heat transfer medium which may contact the vessel, wherein the second heat transfer medium is different from the first heat transfer medium. The second heat transfer medium may be heated by being operatively associated with a heating source selected from the group consisting of nuclear energy, solar energy, electric energy or combustion of fossil fuels, natural gas or hydrocarbon gas. In another embodiment, the first heat exchanger may comprise at least one exchanger tube positioned in the first heat transfer medium. The second heat transfer medium may flow within the exchanger tube to heat the first heat transfer medium. In such an embodiment, the at least one exchanger tube may be operably connected to a second heat exchanger which may be configured to heat the second heat transfer medium as described above.

Moreover, the first heat transfer medium may be positioned in a hermetically sealed circuit so that essentially no loss of the first heat transfer medium occurs during heating, utilizing and recycling. A control mechanism may be provided for controlling the flow of gas though the apparatus and a plurality of sensors may be operably associated with the control mechanism for detecting characteristics of the apparatus (e.g., position of the pistons). The apparatus may also have one or more valves for directing movement of the first heat transfer medium. The one or more valves may be electronically controlled by the control mechanism.

In one embodiment, the first mechanical device or engine/motor/turbine may have a housing, a first piston positioned within a first chamber in the housing, a second piston positioned within a second chamber in the housing and a valve for directing the increased pressure gas between the first and second chamber. The valve may move between a first and second position and may be sized and configured so that, in a first position, the increased pressure gas may enter the first chamber so that the first piston moves in a first direction and, in a second position, the increased pressure gas may enter the first chamber so that the first piston moves in a second direction.

The first and second chambers may have spent gas positioned therein. The first mechanical device may have a passageway connecting the first and second chambers so that spent gas positioned within the first chamber moves to the second chamber as the increased pressure gas enters the first chamber. The first mechanical device may have an outlet which may be sized and configured so that spent gas positioned within the second chamber moves out of the second chamber as gas moves from the first to the second chamber. The gas passing through the outlet may be a lower pressure gas which is at a lower pressure than the increased pressure gas. The additional mechanical device(s) may be configured the same as the first mechanical device. In the automotive context, the additional mechanical device may be used to run, for example, an alternator, air conditioning, a pump and/or a compressor The apparatus may also have a compressor for receiving the lower pressure, spent gas. The compressor may be sized and configured to increase the pressure of the lower pressure, spent gas. The conversion device (e.g., a condenser) may receive the gas from the compressor and may be configured to change the gas to a liquid.

In another embodiment, the apparatus may comprise a vessel for containing a heat transfer medium in a first form, a heating source operably associated with the vessel for heating the heat transfer medium so that the medium becomes a gas at a first pressure, a first mechanical device configured to use the gas to provide mechanical energy and produce a spent gas, one or more additional mechanical devices configured to use the gas to provide mechanical energy to one or more components and produce spent gas, and a conversion device for converting the spent gas back to the first form for reuse. The first form may be a liquid. The gas enters the first mechanical device and additional mechanical device at the first pressure and leaves the first mechanical device and additional mechanical device at a second pressure, wherein the second pressure is less than the first pressure.

The invention also pertains to a method for generating mechanical energy comprising: providing an apparatus comprising a heat exchanger containing a first heat transfer medium in a first form, a first mechanical device operably associated with the heat exchanger, one or more additional mechanical devices operably associated with the heat exchanger, and a conversion device operably associated with at least one of the first mechanical device and the one or more additional mechanical devices; heating the first heat transfer medium from a first temperature to a second higher temperature to provide an increased pressure gas; utilizing the increased pressure gas to operate the first mechanical device and the one or more additional mechanical device to provide mechanical energy wherein the devices form a spent gas; operating one or more primary components with the mechanical energy produced by the first mechanical device; operating one or more secondary components with the mechanical energy produced by the one or more additional mechanical devices; and converting the spent gas to the first form for re-use using the conversion device.

The first transfer medium may be heated so that the second temperature is at least about 20 degrees higher than the first temperature in order to generate a pressure increase of at least about 40 PSI. For example, the second temperature may be below 125° F. A second heat transfer medium may be heated to heat the first heat transfer medium. The second temperature may be generally at least 20 to 40 degrees higher than the first temperature in order to generate a pressure increase of at least about 400 to 1000 PSI.

The increased pressure gas may be used to rotate a shaft for generation of power or torque. The rotating shaft may be operatively associated with vehicle wheels to provide motion to the vehicle. In one embodiment, the direction of the increased pressure gas passing can be reversed to provide braking to the wheels and vehicle. In other embodiments, the gas may be used to power a turbine of an aircraft engine to provide flight propulsion. The increased pressure gas may be used to operate one or a plurality of pistons in an engine to generate horsepower in, for example, an automobile. The increased pressure gas may also be used in an engine located on a boat or ship which is operatively associated with a propeller or blade to provide marine propulsion.

BRIEF DESCRIPTION OF THE DRAWING FIGURES

The present invention can be better understood by reference to the following drawings, wherein like references numerals represent like elements. The drawings are merely exemplary to illustrate certain features that may be used singularly or in combination with other features and the present invention should not be limited to the embodiments shown.

DETAILED DESCRIPTION OF THE PREFERRED EMBODIMENTS

Figure 1:
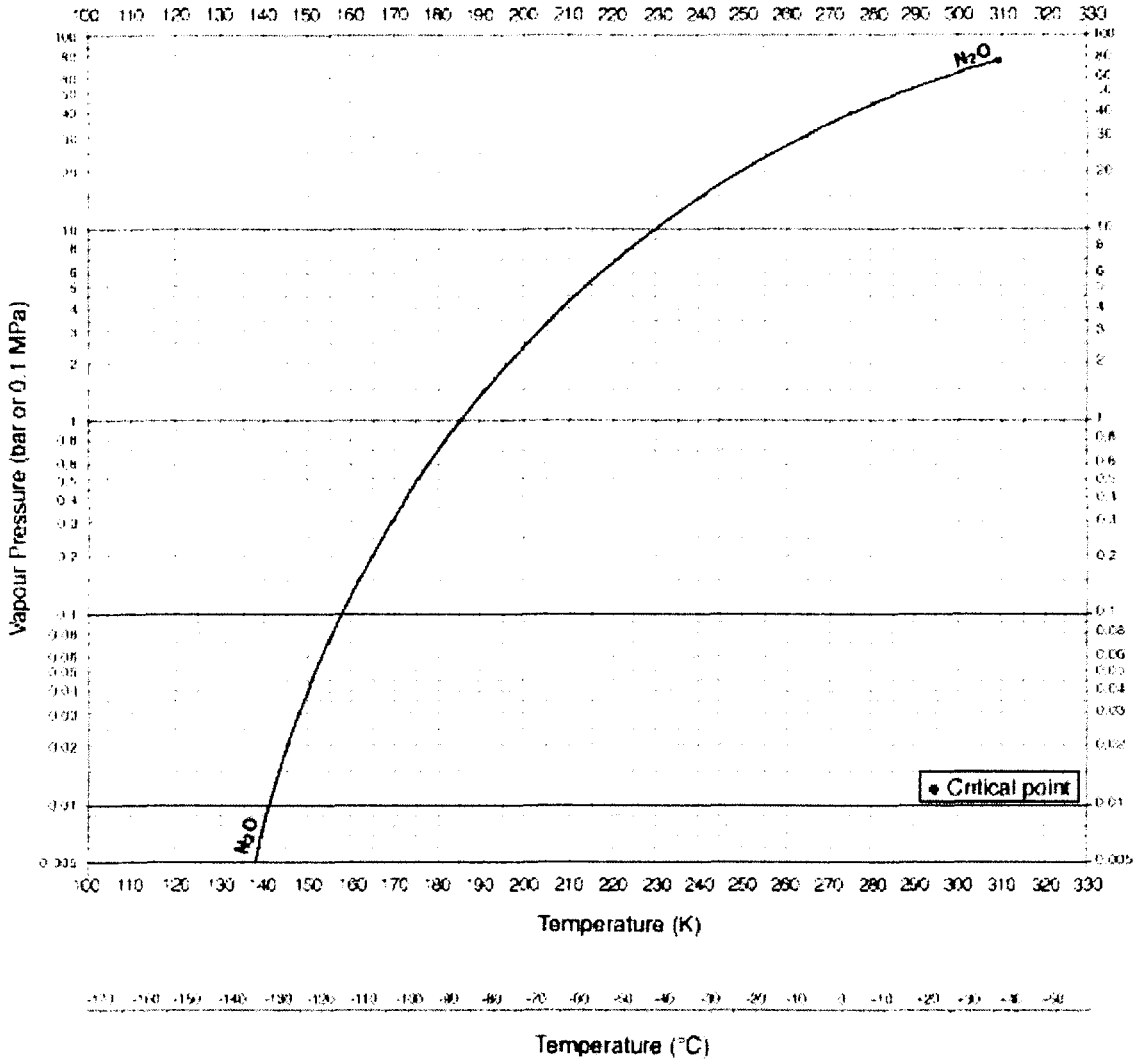
FIG. 1 is a graph of vapor pressure at different temperatures for an expandable gas for use in the invention.

The present invention deviates from the known art by utilizing low temperatures and low boiling point heat transfer mediums in a hermetically sealed system to provide novel power sources. Depending on the heat transfer medium used, the invention preferably operates at temperatures below 125° F. and preferably at a maximum temperature of about 100° F. to avoid combustion of the medium, and to eliminate or significantly reduce the discharge of any gaseous or particulate pollutants. The low temperature also enables low cost, lightweight materials such as, for example, plastic to be used for the equipment that handles the medium, thus enabling lightweight engines or other mechanical force generating devices to be made and used.

Any one of a wide variety of heat transfer mediums can be utilized in this invention provided that they meet certain criteria. Advantageously, these mediums should generate relatively high pressures at temperatures that are well below the boiling point of water, and generally below 125° F. These mediums also have boiling temperatures that are significantly below the freezing point of water. Pressures of at least about 400 to as high as about 500 to 1200 PSI or more can be provided at a heating temperature in the range of about 80 to 100° F., with the most preferred mediums having pressure generating temperatures of between about 90 and 100° F. These high pressures are advantageous for efficiently operating turbines or related equipment for generating power or torque.

A suitable gas would be one which produces at least a 1.5 to 40 PSI rise in pressure for each degree F. heat rise. The usable gases are operable within a friendly temperature range of from 0° F. to 125° F. and preferably from about 50 to 100° F. and which produce increased pressure readings of from 50 PSI to 4000 PSI. Generally, the lower temperature gases would be usable in lower temperature climates to avoid having to cool the gas before generating the increased pressure. Of course, it is within the scope of this invention to cool the medium to a lower temperature/lower pressure condition and then expose the cooled gas to ambient temperatures to provide the increased pressure.

The term "ambient temperature" is used in its ordinary meaning to define temperatures that are comfortable to humans. This is often called "room temperature" and is generally in a range of between about 60 and 75° F.

The invention now allows the use of common gasses to create the potential energy of large power units. These power units are accomplished by manipulating existing energy units with basic tools and processes and letting these units influence and exploit the properties of these expandable gas. As there is no destruction or derogation of any fuel matter, the cost of fuel will be limited to material handling only.

Additional characteristics of the mediums include that they are non-harmful to human life or the environment and non-flammable. Preferably, they are non-corrosive to plastic or metal piping or equipment that is used to transport or store the medium. For these reasons, fossil fuel gases are not preferred for use in this invention. Also, the medium selected should be readily available, inexpensive, and capable of being transported, shipped, stored, handled and utilized by conventional mechanical equipment, i.e., tanks, pumps, valves, seals, piping or tubing, etc. Ease of bulk or raw material storage is another desirable advantage. One of ordinary skill in the art can readily select the optimum gas from known entities.

The most advantageous heat transfer medium is nitrous oxide, as it satisfies essentially all of the most desirable attributes of the expandable gas of the invention. This gas has the following properties:

Molecular Weight: 44.013 g/mol
Solid Phase
Melting point: −91° C.
Latent heat of fusion (1.013 bar, at triple point): 148.53 kJ/kg
Liquid Phase
Liquid density (1.013 bar at boiling point): 1222.8 kg/m3
Liquid/gas equivalent (1.013 bar and 15° C. (59° F.)): 662 vol/vol
Boiling point (1.013 bar): −88.5° C.
Latent heat of vaporization (1.013 bar at boiling point): 376.14 kJ/kg
Vapor pressure (at 20° C. or 68° F.): 58.5 bar Critical Point
Critical temperature: 36.4° C. (96° F.)
Critical pressure: 72.45 bar Gaseous Phase
Gas density (1.013 bar at boiling point): 3.16 kg/m3
Gas density (1.013 bar and 15° C. (59° F.)): 1.872 kg/m3
Compressibility Factor (Z) (1.013 bar and 15° C. (59° F.)): 0.9939
Specific gravity (air=1) (1.013 bar and 21° C. (70° F.)): 1.53
Specific volume (1.013 bar and 21° C. (70° F.)): 0.543 m3/kg
Heat capacity at constant pressure (Cp) (1.013 bar and 15° C. (59° F.)): 0.038 kJ/(mol.K)
Heat capacity at constant volume (Cv) (1.013 bar and 15° C. (59° F.)): 0.029 kJ/(mol.K)
Ratio of specific heats (Gamma:Cp/Cv) (1.013 bar and 15° C. (59° F.)): 1.302256
Viscosity (1.013 bar and 0° C. (32° F.)): 0.000136 Poise
Thermal conductivity (1.013 bar and 0° C. (32° F.)): 14.57 mW/(m.K)

Nitrous oxide (or nitrogen (I) oxide, chemical compound, $N_2O$), is a colorless gas with a sweetish taste and odor. Its density is 1.977 grams per liter at STP. It is soluble in water, alcohol, ether, and other solvents. Although it does not burn, it supports combustion since it decomposes into oxygen and nitrogen when heated. The gas is prepared commercially by the thermal decomposition of ammonium nitrate, $NH_4NO_3$, at about 240° C.; to produce nitrous oxide and water; the reaction must be carefully controlled to prevent explosive decomposition of the nitrous oxide. The gas is purified, liquified by compressing and cooling it, and stored in metal cylinders. It is generally available at a relatively reasonable cost. It is easy to handle and it is a familiar gas as it is commonly used in anesthesia, e.g., in dentistry. It is called laughing gas since it produces euphoria and mirth when inhaled in small amounts. It is also used in making certain canned pressurized foods, e.g., instant whipped cream. A graph of its vapor pressure at different temperatures appears in FIG. 1.

As the amount of energy required to warm the medium to its operating pressure is modest, all that is required is a relatively small heating unit for this purpose. Such a unit can operate on any one of a wide variety of energy sources, including nuclear, electric, solar, natural or hydrocarbon gases, or alternative fossil fuels such as alcohol, vegetable oils or other replenishable materials. The heating unit can directly or indirectly heat the medium. For example, a second heat transfer fluid can be heated by the heating unit, and the heated second medium can be used to heat the first heat transfer medium.

One of ordinary skill in the art will readily recognize that electric power for public and industrial use can be generated from the present system by simply applying heat from various available sources. These sources include thermo-wells and springs, or even sunlight, supplemented where necessary by sources such as natural or other hydrocarbon gas, other fossil fuels or any of the sources described above, to obtain the relatively low temperature for heating the medium. This in turn reduces the size of power plants to a sufficiently small and compact arrangement so that they can be utilized locally in a town, a building or even in a person's home.

The hermetic sealing of the system avoids the generation of environmental pollutants, cooling systems are not required and the system can be operated at extremely low noise levels. When used, nuclear power plants for heating the medium can be sized at a fraction of their current size due to the low operating temperatures needed for the present system. Also, any waste heat that is generated can be collected and diverted to the source for heating the medium.

In another embodiment, a fluorocarbon may be used in place of nitrous oxide. In a preferred embodiment for fluorocarbons, AZ-20 may be used as the heat transfer medium. Similar to nitrous oxide, fluorocarbons may also generate high pressures when heated to temperatures below the boiling point of water and, generally below 190° F. Those skilled in the art, however, will appreciate that any medium may be used so long at it produce high pressure at relatively low temperatures such as, for example, below the boiling point of water.

Figure 2:
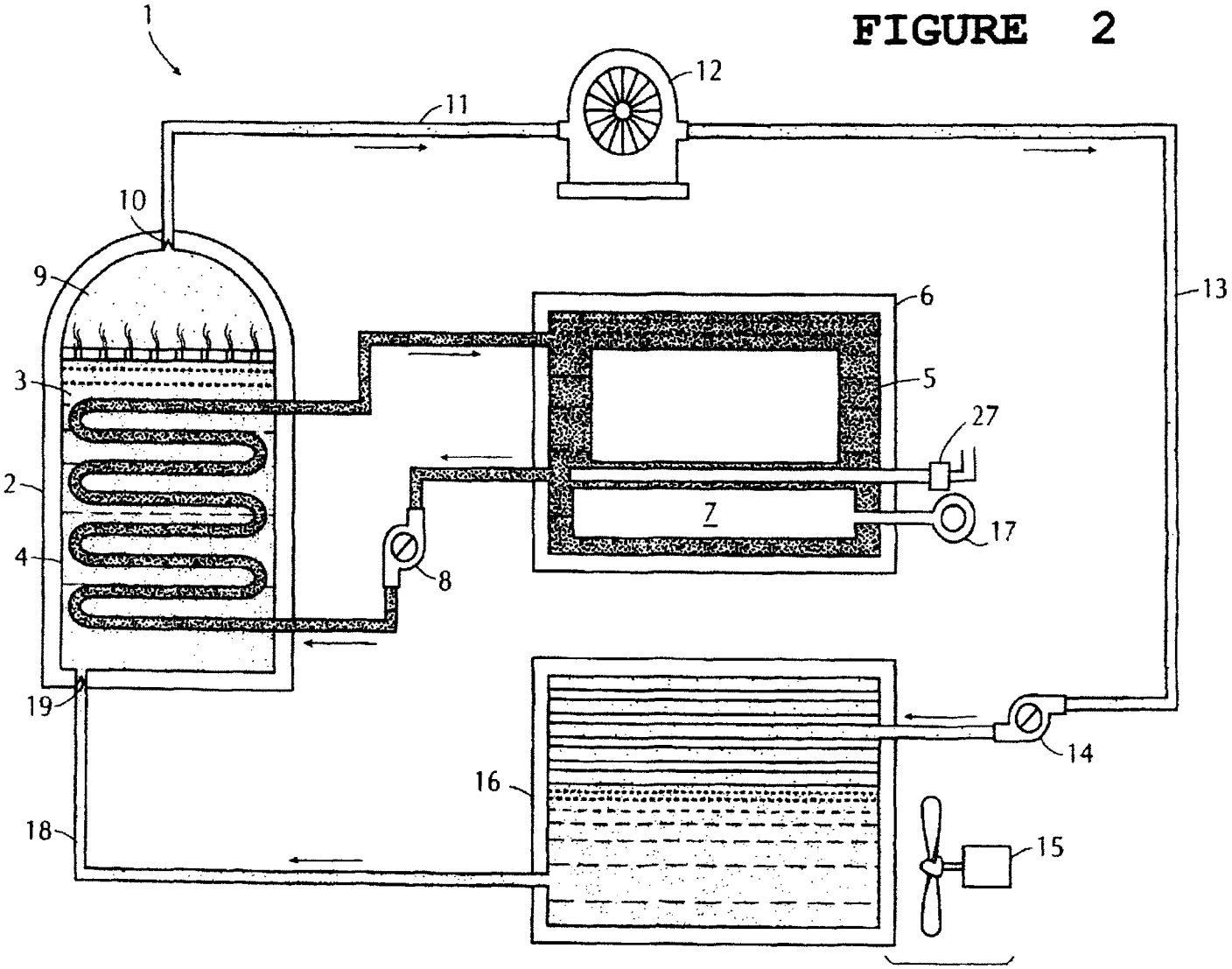
FIG. 2 is a schematic of an exemplary embodiment of a closed loop heat transfer circuit.

Referring to FIG. 2, there is illustrated a vapor engine 1 according to the invention. A vessel 2 contains a liquid heat transfer medium, 3, preferably nitrous oxide as noted above, which medium is capable of generating a high pressure when heated to a vapor. For this reason, vessel 2 is provided with a heat exchanger 4. The heat exchanger contains ethylene glycol 5 and is connected to a vessel 6 that contains a supply of that medium. The vessel 6 is heated by a boiler heat exchanger 7 or other suitable heating means to a temperature of about 95° F. As the critical temperature of nitrous oxide is 96° F., it is above the temperature of the heating means and it also allows the operation temperature is maintained relatively low. The boiler 7 can be heated by any one 17 of a number of sources, including nuclear, combustion of fossil fuel, natural gas or alcohol, electric, solar, or combinations thereof. In addition, the system can include an electric heating element 27 for cold starting capabilities. This can be used alone or in combination with the boiler. Pump 8 circulates glycol 5 between heat exchanger 4 and supply vessel 6.

Heat from glycol 5 in heat exchanger 4 causes the medium to vaporize and generate a high pressure vapor 9 in the upper part of vessel 2. Check valve 10 assures proper flow of the high pressure vapor 9 through piping 11 and to turbine 12 or other power producing device. If desired, electricity can be generated or the turbine can be operatively associated with wheels or other motion generating devices to product torque or other forces to drive the device. Thereafter, vapor 9 continues through piping 13, urged by pump 14, to condenser 16, where fan 15 cools the gas and returns it to a liquid. This liquid passes through piping 18, and through check valve 19 into vessel 1 for re-use.

As noted above, the invention has utility for automotive and marine transportation, and due to the low temperatures of operation, the materials of construction for the equipment can be engineering thermoplastics such as nylon, polycarbonate, moldite, thermosetting plastics or composites and the like. Also, lightweight metals such as aluminum, titanium or magnesium can be used. This significantly reduces the complexity and weight of the engine that contains the system of the invention. This also simplifies servicing of the engine, with long life and reliable operation being provided. As there is no internal combustion, there is no exhaust and no air pollution generated.

Furthermore, no transmission is needed as the output can be used to directly drive the wheels. The engine has torque and horsepower of larger internal combustion engines due to the relatively high applied pressure of the vapor for the full stroke of the piston. The moving parts of the engine would be permanently lubricated so that no further maintenance is required. Also, no radiator or water system is required.

Electronically controlled valves or valving arrangements facilitate operation of the system, and the heat transfer mediums are non-flammable, so that there is no concern of an engine fire. The return line for the condensed first liquid heat transfer medium can be used for this purpose, as this assists in warming the liquid and generating the vapor. When this system is used as the engine of a vehicle, the relatively cold return line can also be used to cool air for providing air conditioning to the vehicle occupants. The cooling of all electronic devices in the system increases the reliability and life of the components. A master control unit is the heart of the control system and is programmed to perform all functions.

The system is not affected by atmospheric conditions, i.e., barometric pressure, humidity or temperature. The reliability of all components is assured by the hermetics of the system. The complete isolation of the system from atmospheric exposure contributes to the long operational life of the system.

An important feature of this system is the elimination of all internal fuel components, such as injectors, fuel pumps, catalytic converters, fuel rails, and sensors which are costly, troublesome and hazardous but are necessary to the operation of an internal combustion engine.

Today's engines also have become a complexity of mechanical and electronic components, complicated valve trains with 2 to 5 valves per cylinder, ignition systems using 1 to 2 sparkplugs, multiple ignition coils, and the ultimate in the combustion process, fuel systems and fuel injection processes. Added to this is the exhaust system with catalytic converters and specialized mufflers. Both standard gasoline and Diesel engines require most of these components to function. Their efficiency is still low due to the inability to burn fuel completely. This results in incomplete combustion and atmospheric pollution.

Kinetic energy also requires a source of thermal means. Presently fossil fuels and alcohols derived from plants and vegetation are used to accomplish this. The high temperatures of combustion require that the engine materials be made of special alloys and other sophisticated materials. In contrast, the present invention accomplishes its power cycle at a maximum temperature of about 160° F. with a chemical action used to create high pressures which are converted to rotary and linear motion. The low temperatures of 160° F. negates the need for super metals and other materials used in the internal combustion engines. High strength and lightweight plastics can be substituted for metals and alloys.

The elimination of many of the components mentioned above makes this type of motive power simple, safe, economical, durable, and above all, since it has no atmospheric exhaust, is non-polluting and environmentally clean.

Figure 3:
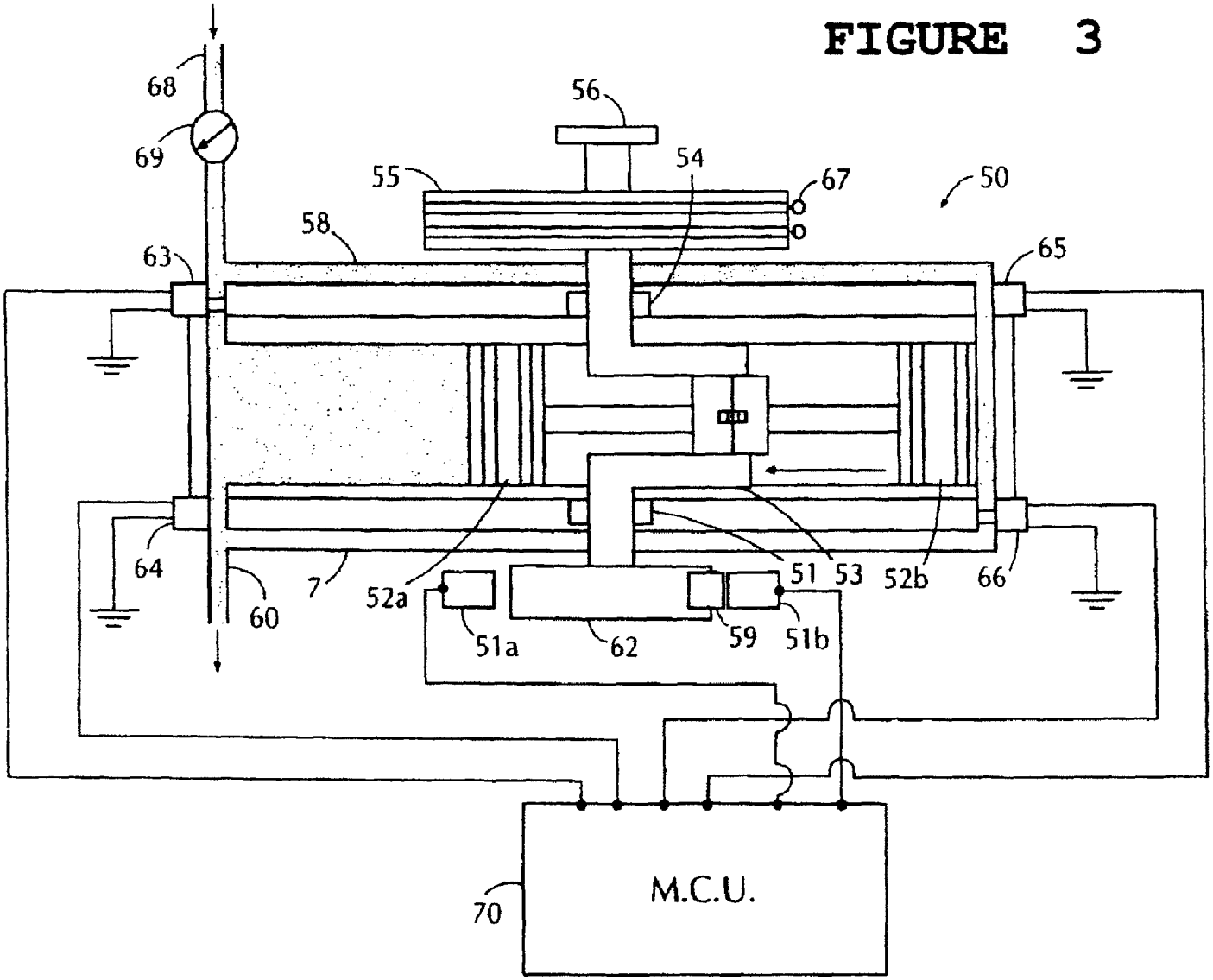
FIGS. 3 and 4 illustrate an exemplary two-cylinder vapor engine at different points in the cycle of piston stroke.

FIG. 3 shows a two-cylinder configuration vapor engine 50. This engine is devoid of most of the complications of the internal combustion engines. This engine is completely electronic, controlled by the master control unit or MCU 70. This unit is a programmable microprocessor which is utilized to actuate valves, solenoids or other electronic components to open or close various passages to direct pressurized gas into or spent gas from the ends of the chambers behind the piston heads. The only rotating parts of this apparatus are pistons 52A, 52B and crankshaft 53. All electric valves are actuated and programmed through the MCU 70, which receives information from magnetic sensors 51A, 51B, triggered by magnet 59, mounted on timing wheel 62. Solenoids 63, 64, 65, and 66 are energized by the trigger magnet 59 and sensors 61A, 61B according to the programming of the MCU 70.

As can readily be seen, high pressure vapor enters conduit 68 from vessel 2, passes through throttle valve 69 to manifold 58. Solenoids 63 and 66 are de-energized allowing vapor to flow through manifold 58 to right side cylinder 52B to expand into the chamber behind piston 52B to urge it to move towards crankshaft 53 and piston 52A. At the same time, piston 52A moves away from the crankshaft 53 to exhaust spent vapor through manifold 60 to the suction side of the condenser 16 for recycle and re-use. Flywheel 55 contains the electrical windings of a 42-volt alternator, and power is transmitted through contact brushes 67. Attached to crankshaft 53 and flywheel 55 is output flange 56.

Figure 4:
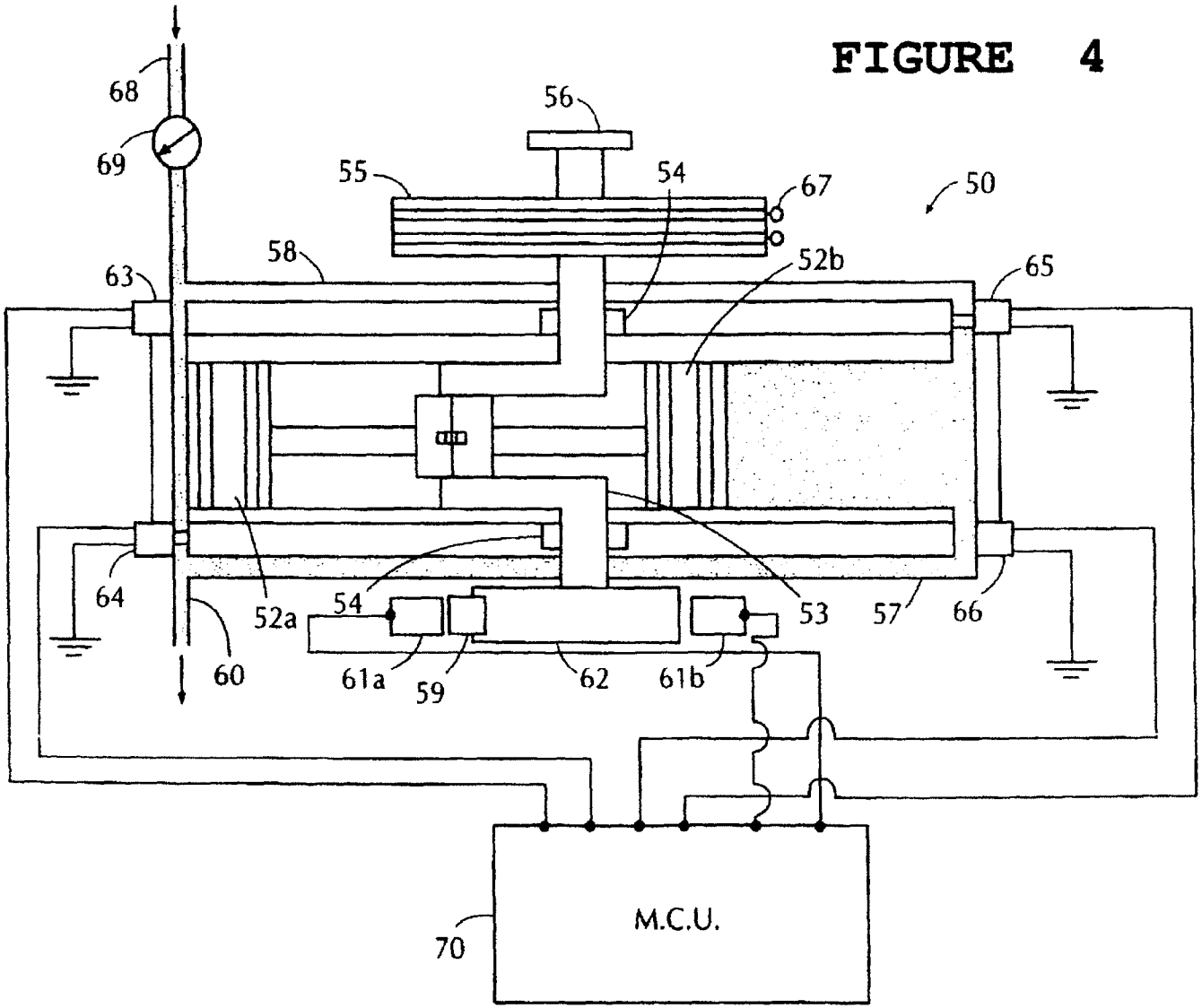

Turning now to FIG. 4, piston 52A has reached the end of the chamber and all exhaust vapors have been vented. The trigger magnet 59 on rotating timing wheel 62 approaches sensor 61A in turn causing the MCU 70 to energize solenoids 65 and 66 and de-energize solenoids 63 and 64 to thus allow entry of pressure into the chamber behind piston 52A. Pressure vapor from conduit 68 flows through throttle 69 into the cylinder chamber behind piston 52A to move it towards crankshaft 53 and piston 52B, forcing spent vapor in the cylinder chamber behind piston 52B to exit through manifold 57 to tube 60 and back to suction side of condenser 16.

Speed, reversing and stopping of engine is accomplished by programming the MCU 70 for desired control and performance. High-pressure seals 54 on crankshaft 53 insure that no vapor is lost. The complete unit can be hermetically sealed from the outside atmosphere, if desired. As one of ordinary skill in the art would readily understand, the engine 50 can be configured with any number of pistons and cylinders and any style of block.

Figure 5:
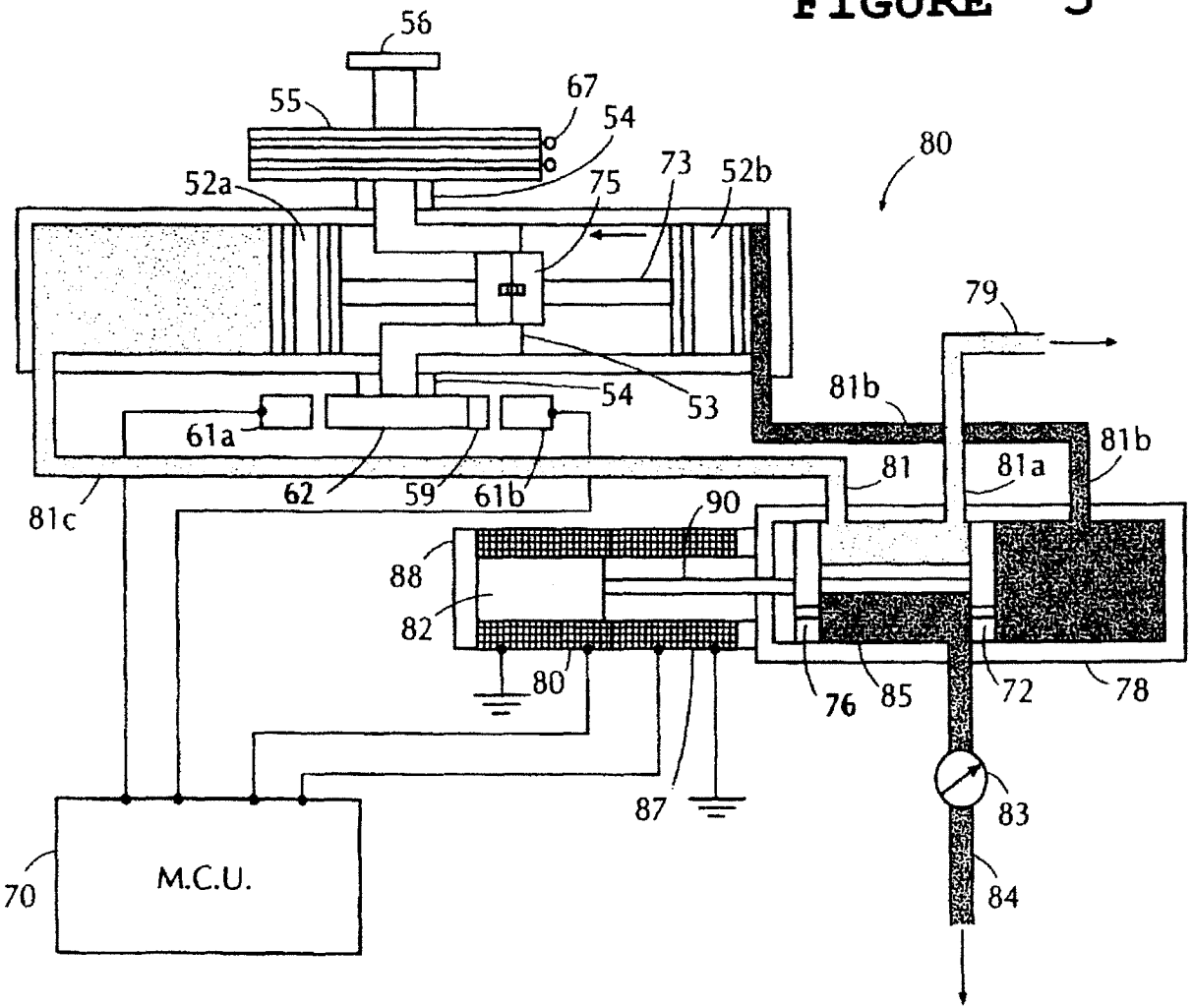
FIG. 5 is an exemplary embodiment of a two-cylinder engine which utilizes a solenoid actuated slide valve.

FIG. 5 shows a similar form of a 2-cylinder engine configuration 80 where like components to those of FIGS. 2 and 3, but using a solenoid actuated slide valve member 78 and solenoid 88. As magnetic impulse is sensed from magnet 59 by sensor 61B as magnet 59 moves along the rotating timing wheel 62, the MCU control 70 energizes coil 80 of solenoid 88 allowing solenoid coil 80 to draw slide valve 85 by rod 90 so that port manifold tube 72 allows vapor from tube 84 to pass through throttle valve 83 to flow through port 72 of slide valve 85. Manifold 81B allows vapor to flow to piston 52B forcing piston to move toward crankshaft 53. Piston 52A is now moving away from crankshaft 53 forcing spent gasses in that cylinder to exit through manifold 81C to port 81 through upper section of slide valve 85, then out through port 81A to return line 79 to condenser 16. As crankshaft 53 reaches dead center, magnet 59 energizes sensor 61A, whereby solenoid core 82 is attracted to solenoid coil 87, to repeat the cycle in the opposite direction. Seals 54 on crankshaft insure that all gas is safely contained within the system. The flywheel 55 contains windings for a 42 volt system and shown are the brushes 67. Flange 56 is for transmission of external power. As with the other design, the entire unit can be encapsulated, if desired.

Figure 6:
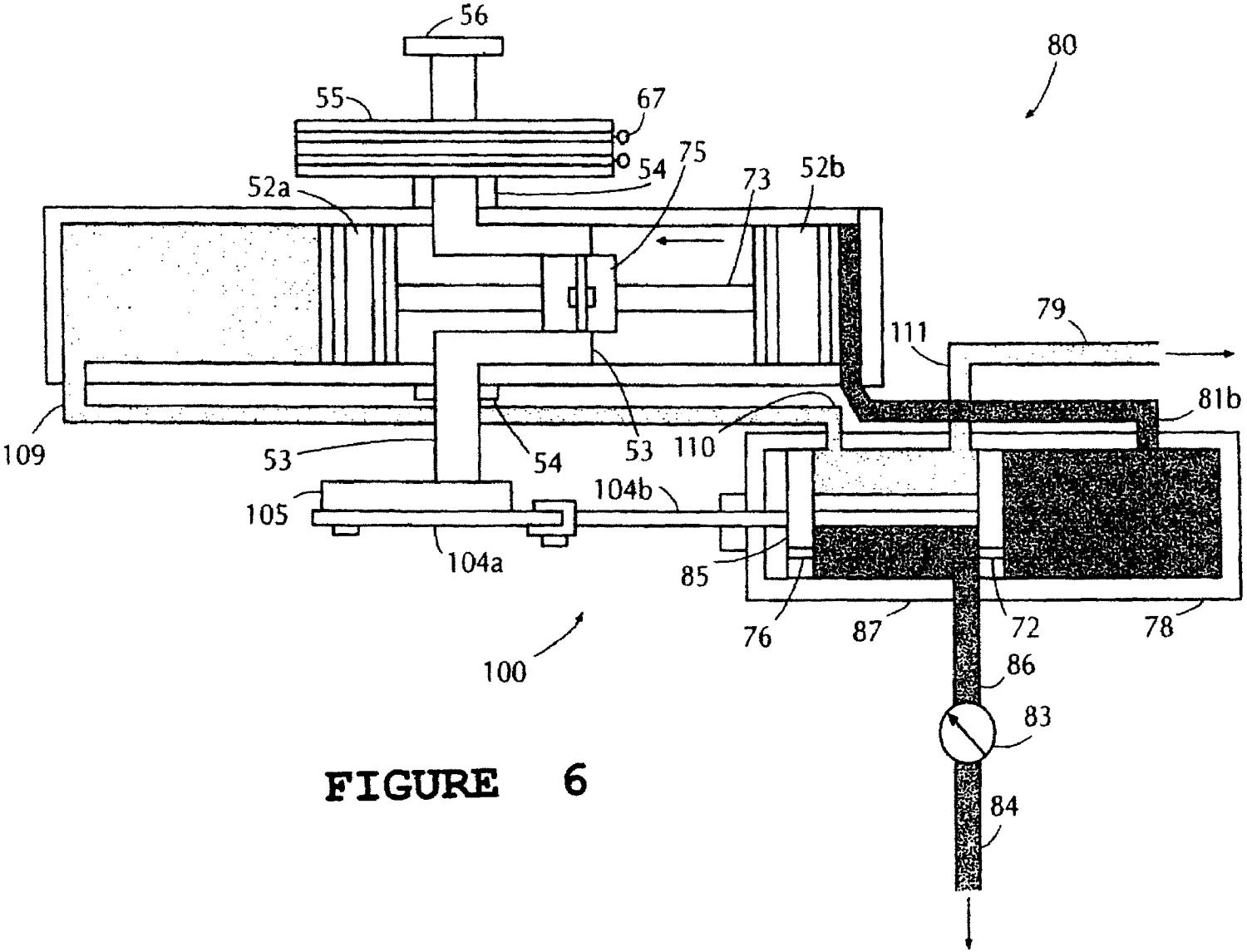
FIG. 6 is an exemplary embodiment of the engine of FIG. 4 with a mechanically actuated linkage.

FIG. 6 shows the same engine 80 with a mechanically actuated linkage 100 for slide valve 85. As high pressure gas or vapor passes through throttle valve 83 into manifold 86 slide valve 85 is positioned in housing 87 by the action of cam 105 and linkage 104A and 104B. Vapor passes through slide valve port 109 to piston 52B. Piston 52A is forced to move, thus rotating crank 53 with piston 52A exhausting spent vapor through manifold 109 through slide valve ports 110 and 111 to tube 79 and then to condenser 16. As crankshaft 53 rotates, cam 105 has advanced 180 degrees to activate linkage 104A and 104B to move slide valve 85 to the opposite side of slide valve housing 87. Ports 111 and 109 become the exhaust ports and port 110 becomes the inlet port, due to the position of the slide valve 85. Seals 54 again ensure prevention of leakage of the vapor. Flywheel 55 contains the windings of a 42-volt alternator. The brushes 67 direct current to the electrical system.

Figure 7:
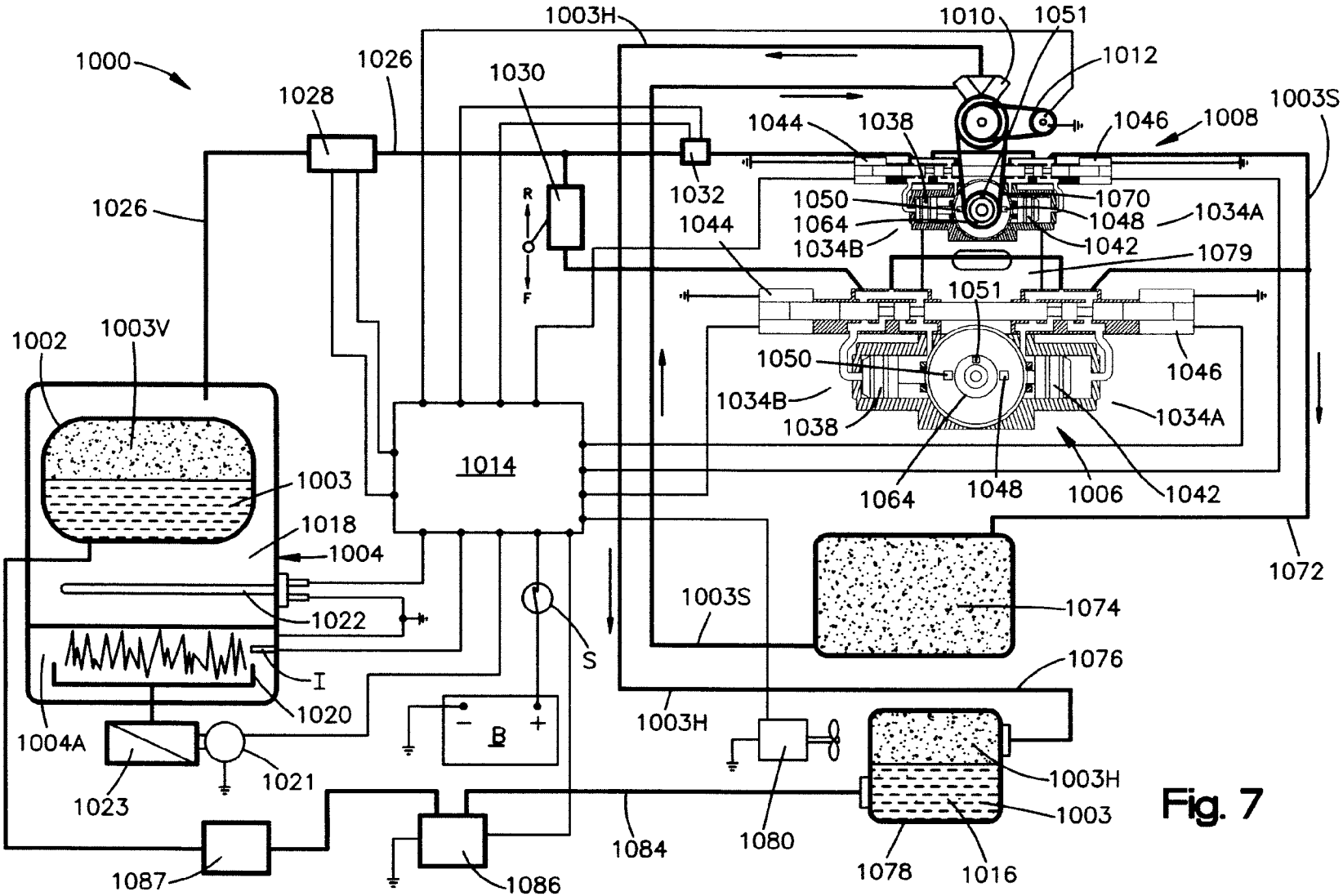
FIG. 7 is a schematic of an alternative exemplary embodiment of a closed loop heat transfer circuit.

In another embodiment, as illustrated in FIG. 7, a vapor engine 1000 may have a vessel 1002 configured to receive and contain a heat transfer medium 1003 (e.g., nitrous oxide) which may be in a first form (e.g., liquid), a heating assembly 1004, a first mechanical device or engine 1006, at least one additional mechanical device or engine 1008 for operating one or more components (e.g, components 1010, 1012), one or more master control units or MCU 1014 and a condenser 1016. One or more batteries B may provide power to the MCU 1014. The power to the MCU 1014 may be shut on/off using a switch S. The heat transfer medium 1003 may be capable of generating a high pressure when heated to a gas or vapor 1003V. As illustrated in FIG. 7, the vessel 1002 may be positioned within heating assembly 1004. In an alternative embodiment, the heating assembly 1004 may be separate from but operably connected to the vessel 1002 such as, for examples, shown in FIG. 2. The heating assembly 1004 may contain a second heating medium such as, for example, ethylene glycol 1018 which may be heated by a heat exchanger 1020 or other suitable heating means to a temperature of about 95° F. Those skilled in the art will appreciate that the heat exchanger 1020 is capable of heating a medium 1003 to any temperature which is required to form a vapor or gas at a certain pressure to perform a particular function. Moreover, other second heating mediums are envisioned. The heat exchanger 1020 can be provide heat from one of a number of sources, including nuclear, electric or solar power, or the combustion of fossil fuel, natural gas or hydrocarbon gases or combinations thereof. The heat exchanger 1020 may be is a separate compartment 1004*a* than the second heating medium 1018. In some embodiments, a fuel gun 1021 may be used to inject fuel from a fuel tank 1023 into the compartment 1004. The fuel gun 1021 may be controlled by the MCU 1014. Combustion may be initiated by an igniter I which may also be controlled by the MCU 1014. In addition, the heating assembly 1004 can include an electric heating element 1022 for cold starting capabilities. The heating element 1022 may be used alone or in combination with the heat exchanger 1020.

Heat from the second heating medium 1018 in heating assembly 1004 may cause the first heating medium 1003 to vaporize and generate a high pressure vapor or gas 1003V in the upper part of vessel 1002. The vapor or gas 1003V may exit the heating assembly 1004 and travel along a conduit or path 1026. The conduit 1026 may be any shape or size so long at the vapor or gas 1003V may pass therethrough at the required speed and pressure. The conduit 1026 may be piping which may be positioned between the heating assembly 1004 and the mechanisms 1006 and/or 1008.

A check valve (not shown) may be positioned within the heating assembly 1004, between the heating assembly 1004 and path 1026 and/or in the path 1026 and may be opened/closed or energized/de-energized by the MCU 1014 to allow vapor 1003V to pass into the conduit 1026. The check valve may be a one-way check valve which may prevent vapor 1003V from re-entering the vessel 1002. The check valve may assure proper flow of the high pressure vapor 1003V through conduit 1026 to first mechanical device 1006 and/or one or more additional mechanical device 1008. A pressure regulator 1028 may be positioned along the conduit 1026 between the heating assembly 1004 and the device 1006, 1008. The pressure regulator may control the pressure of the vapor 1003V entering the devices 1006 and/or 1008, so that the vapor 1003V is at an ideal pressure for driving the devices 1006 and/or 1008.

Moreover, a throttle 1030 may be operably associated with the conduit 1026 between the heating assembly 1004 and the mechanical device 1006. The throttle 1030 may be used by an operator to control the power generated by the mechanical device 1006 by controlling the amount of vapor 1003V which enters the mechanical device 1006. Similarly, a modulator valve 1032 may be operably associated with the conduit 1026 and may control the amount of vapor 1003V entering one or more mechanical devices 1008, thereby controlling the power of the mechanical device(s) 1008. In some embodiments, a throttle may be use instead of or in addition to the valve 1031 to control the amount of vapor 1003V entering one or more mechanical devices 1008.

Figure 8:
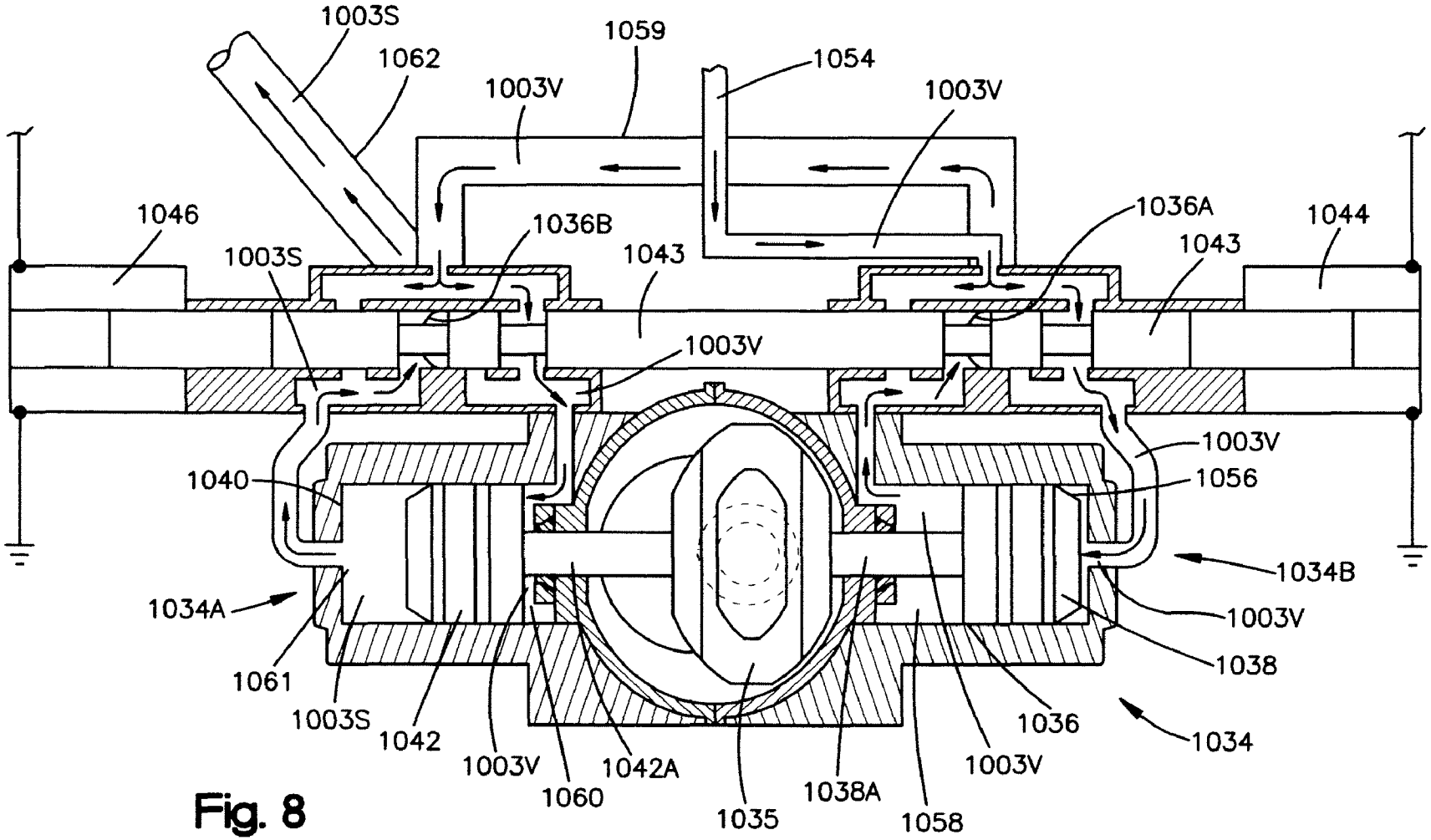
FIGS. 8 and 9 illustrate an alternative exemplary two-cylinder vapor engine at different points in the cycle of the piston stroke.
Figure 9:
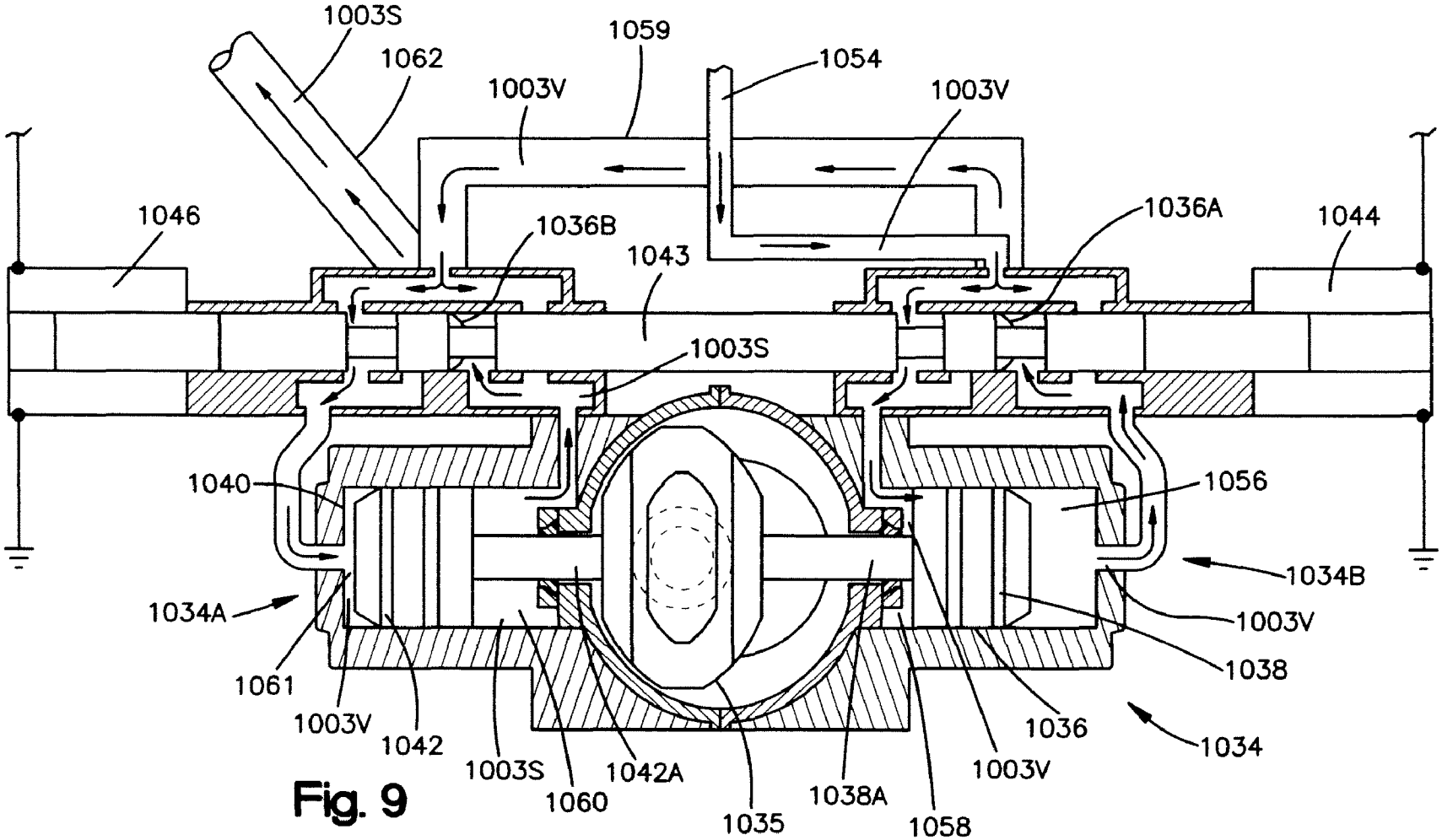

It should be noted that the mechanical devices or engines 1006, 1008 may be the same type of engine or different engines. As shown in FIGS. 8 and 9, the mechanical device or engine 1006, 1008 may have a housing 1034 having a first end 1034*a* and a second end 1034*b*, a moveable member 1035, a first chamber 1036 within the housing 1034 containing a first cylinder or piston 1038, a second chamber 1040 within the housing 1034 containing a second cylinder or piston 1042, a valve 1043 and a plurality of solenoids 1044, 1046. With the valve 1043 in a first position as shown in FIG. 8, high pressure or input vapor 1003V enters the engine 1006, 1008. The vapor 1003V flows through a first passageway 1054 and into a first portion 1056 of the first chamber 1036. The pressure of the vapor 1003V moves the first piston 1038 towards the first end 1034*a* of the housing 1034 so that vapor 1003V, which is in a second portion 1058 of the first chamber 1036, moves through an opening 1036*a*, through a second or outlet passageway 1059 and into the second portion 1060 of the second chamber 1040. As the vapor 1003V fills the second portion 1060 of the second chamber 1040, the piston 1042 may move towards the first end 1034*a*, thereby pushing any spent vapor 1003S contained within a first portion 1061 of the second chamber 1040 out of the chamber 1040, through the opening 1036*b* and into a third or exhaust passageway 1062. The spent vapor 1003S exiting the mechanism 1006, 1008 may be at a lower pressure than the input vapor 1003V.

Thereafter, the valve 1043 may move to a second position shown in FIG. 9 by energizing solenoid 1046 and de-energizing solenoid 1044. The MCU 1014 may be used to control the energizing/de-energizing of solenoids 1044, 1046. High pressure or input vapor 1003V may flow into the second portion 1058 of the first chamber 1036. The pressure of the vapor 1003V moves the first piston 1038 towards the second end 1034*b* of the housing 1034 so that vapor 1003V, which is in first portion 1056 of the first chamber 1036, moves through the opening 1036*a* and through a second or outlet passageway 1059 into the first portion 1061 of the second chamber 1040. As the vapor 1003V fills the first portion 1061 of the second chamber 1040, the piston 1042 moves towards the second end 1034*b*, thereby pushing any spent vapor 1003S contained within the second portion 1060 of the second chamber 1040 out of the second chamber 1040, through the opening 1036*b* and into a third or exhaust passageway 1062. The spent vapor 1003S may be at a lower pressure than the input vapor 1003V. The valve 1043 then moves towards the first position of FIG. 8 by energizing solenoid 1044 and de-energizing solenoid 1046. This process is repeated multiple times to produce mechanical energy. Those skilled in the art will appreciate that any other device which can move the valve 1043 may be used instead of the solenoids 1044, 1046.

The pistons 1038, 1042 may be operably connected to rods 1038*a*, 1042*a* which, in turn, may be connected to the moveable member 1035. As the pistons 1038, 1042 move back and forth, the moveable member 1035 may rotate, thus providing motion to various components such as, for example, a drive shaft for moving the wheels of a car, turbines of an engine (airplane engine) or propellers of a boat. In one embodiment (not shown), the moveable member 1035 may provide energy to power the alternator 1012 of an automobile. In such an embodiment, a belt may be connected to the moveable member 1035 and the alternator 1012.

The mechanical device 1006, 1008 may have a timing member 1064, sensors 1048, 1050 and a triggering device 1051 (e.g., a magnet) which may be mounted to the timing wheel 1064. The timing member 1064 may be operably attached to the moveable member 1035 and may rotate with the moveable member 1035 as the pistons 1038, 1042 move back and forth. As the pistons 1038, 1042 move toward the first end 1034*a* of the housing 1034 and the moveable member 1035 rotates, the timing wheel 1064 and, thus, the triggering device 1051 may move or rotate towards the sensor 1048. When the triggering device 1051 is positioned proximate the sensor 1048, the sensor 1048 may send a signal to the MCU 1014 (or the MCU 1014 may detect a signal) which, in turn, may energize the solenoid 1044 and de-energize solenoid 1046 to move the valve 1043 from the first position (FIG. 8) to the second position (FIG. 9). As the pistons 1038, 1042 move toward the second end 1034*b* of the housing 1034, the timing wheel 1064 and triggering device 1051 may move or rotate towards the sensor 1050. When the triggering device 1051 is positioned proximate the sensor 1050, the sensor 1050 may send a signal to the MCU 1066 (or the MCU 1066 may detect a signal) which, in turn, may energize the solenoid 1046 and de-energize the solenoid 1044 to move the valve 1043 from the second position back to the first position. It will be appreciated that any means of sensing the positions of the pistons 1038, 1042 and controlling the position of the valve 1043 may be used.

In some embodiments a first MCU 1014 may be used to operate the first mechanical device 1006 and a second MCU 1014 may be used to operate the additional mechanical device (s) 1008. Alternatively, one MCU 1014 may be used to operate the mechanical devices 1006, 1008 and a second MCU 1014 may be used to operate all other components. In other embodiments, there may be three or more MCU 1014 running groups of components. There may also be embodiments where each component is operated by a separate control unit.

The additional mechanical device(s) 1008 may be connected to the first mechanical device 1006 by one or more brackets 1079. Those skilled in the art will appreciate, however, that the mechanical devices 1006, 1008 may not be directly connected to each other and may be separated from each other in the engine 1000. During times when an engine (e.g., an automobile engine) is idol or not in use, one advantage of having at least one additional mechanical device 1008 may be to provide mechanical energy or power to one or more secondary components (e.g., alternator, compressor, air conditioning unit, radio). In this way, mechanical energy or power generated by the mechanical device 1006 may be conserved (i.e., not diverted) It will be appreciated that, in a preferred embodiment, the additional mechanical device(s) 1008 provide energy to components which are different than the components driven by the first mechanical device 1006.

In one embodiment, a drive member 1070 such as, for example, a belt may be operable attached to the moveable member 1035 of the mechanical device 1008. The drive member 1070 may be connected to a component 1010 such as, for example, an alternator for controlling electrical current of, for example, a vehicle or boat. In an exemplary embodiment of an automobile, such a construction may allow for various components 1010, 1012 of the automobile, such as an alternator, pump (e.g., for air conditioning) or compressor to receive power from the device 1008 without drawing power from the device 1006. In this way, the first mechanical device 1006 may be idol while other components continue to operate. Since the first mechanical device 1006 may produce more energy or power than is required to operate only the secondary components when primary components are not in use, another advantage of providing at least one additional mechanical device 1008 is that the additional mechanical device 1008 may be smaller, require less vapor 1003V to operate and may produce only the energy or power needed to operate the components attached thereto.

The spent vapor 1003S from the mechanism 1006 and/or additional mechanism 1008 may travel along a second path 1072 to a container 1074 (e.g., a dissipater), which may direct the lower pressure vapor 1026 to a compressor 1010 such as, for example, the Copeland Scroll® compressor sold by Copeland Corporation. The compressor 1010 may, in turn, compress the vapor 1003S entering the compressor 1010 so that the vapor 1003S may leave the compressor 1010 at a higher pressure than the vapor 1003S entering the compressor 1010. The high pressure vapor 1003H may then travel along a third path 1076 to a condenser 1078. A fan unit 1080 may be activated by the MCU 1014 and cool the vapor 1003H. As the vapor 1003H cools its may be converted back to liquid form 1003. The liquid 1003 may be moved along a fourth path 1084 by a pump 1086 through a receiver 1087 and back to the vessel 1002 to be reused.

Figure 10:
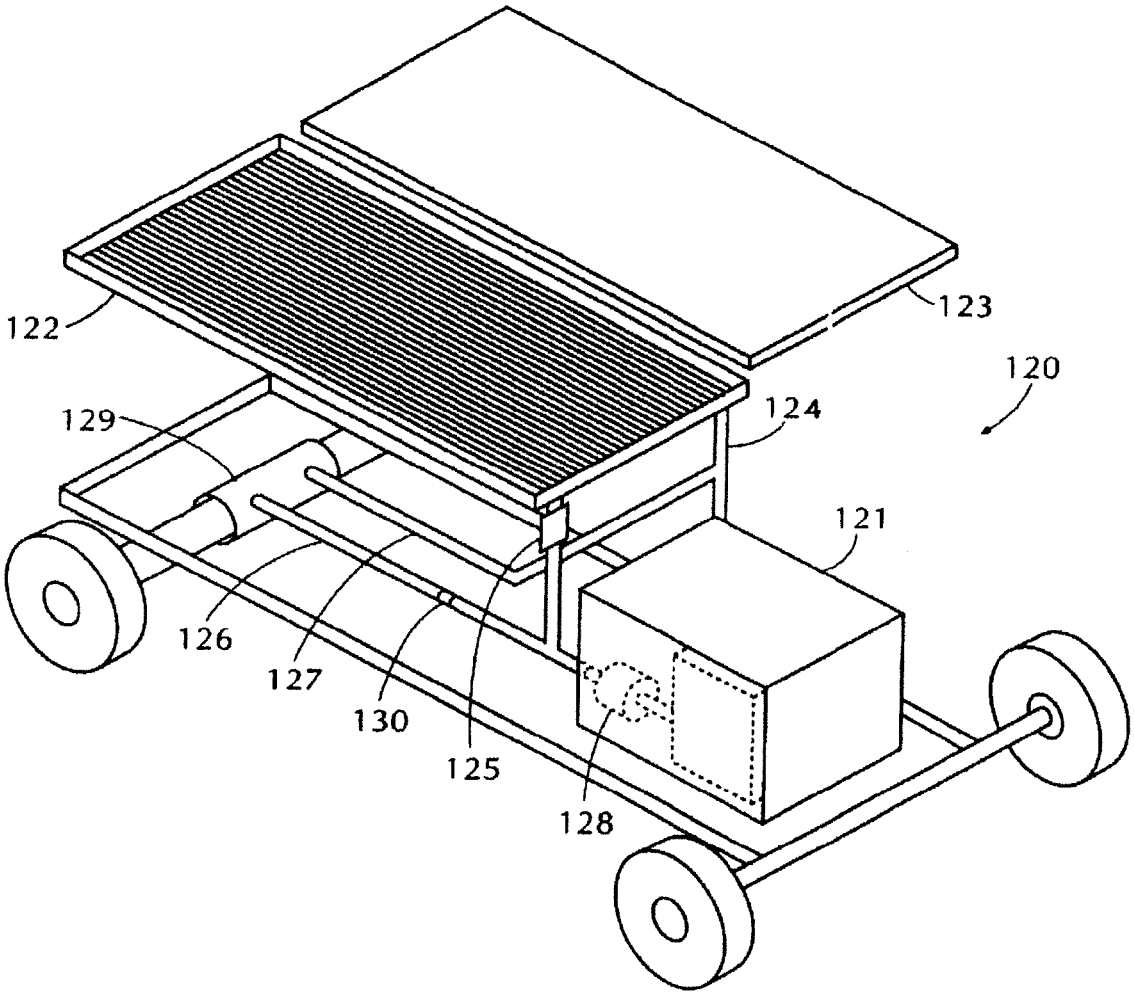
FIG. 10 shows a vehicle which utilizes a solar panel to heat the heat transfer fluid.

FIG. 10 shows a solar powered vehicle 120. The vehicle includes a solar panel 122 connected to the boiler 121 through tube 124 to circulate solar heated ethylene glycol and increased by the boiler heater to 160° F. This in areas of extreme sun increases the thermal efficiency of the unit. The panel is constructed of a grid of hollow copper or aluminum panel through which ethylene glycol is circulated. This solar panel 122 is incorporated in the roof of the vehicle and is protected from the elements by a clear plastic panel 123. Heat can also be absorbed by circulating ethylene glycol through lines 126 and 127 to cool a high efficiency motor which generates a large amount of heat. Pump 128 is the means of returning the fluid to the boiler 121. Thermostat 125 allows only sufficiently heated fluid to circulate. Solenoid valve 130 provides control of fluid from motor 129 or other areas where heat can be derived. These are basic details of a system to which much technology can be directed to attain energy, which is needed by an increasing population demand, and a means of not relying on a diminishing supply of fossil fuels. The use of replenishable fuels, such as alcohols from cane, corn and other vegetable matter can relieve the world problem of atmospheric contamination as we are presently experiencing from fossil fuels.

The vapor engine of the present invention is similar in operation to the steam engine of the early 1900s. Nothing matches the tremendous power and flexibility of those engines, and the present vapor engine can approximate the features of a steam engine. It can rotate in either direction or instantly stop to act as a brake. This eliminates the need for transmissions, resulting in less expensive drive lines for all means of transportation, farm and construction equipment. Power for external use is transmitted via a motor shaft through a housing which is sealed by modern technology, high pressure seals such as those used in automotive air conditioners and refrigeration systems.

The invention also has utility in military applications. Due to the quiet operation, non-exhaust and high power output of the invention, it can be used in tanks, aircraft, ground support vehicles and marine transport vehicles.

EXAMPLE

The following is provided as a comparison of power between an internal combustion engine and a vapor engine according to the invention.

A cylinder with a 4" bore and a 3" stroke has 37.7 cubic inches. The compression ratio is 8.54:1. A combustion force of 5000 pounds translates into 625 pound feet of instantaneous torque.

The same cylinder of the vapor engine of the invention, disregarding the compression ratio with 600 pounds of pressure (0.7854×D2)=(0.7854×16)=12.5664 sq. in.×600 pounds=7,539.84), gives 966 pound feet of continuous torque for the full stroke of the crank. This is an increase of more than 50% compared to the internal combustion engine. Furthermore, in an internal combustion engine, force is gradually depleted as combustion ceases. Also, an internal combustion engine has to proceed through a four cycle process to repeat the power cycle.

The vapor engine of the present invention is double acting in that it develops power with each and every stroke of the piston. This results in a smaller engine with more power and smoother operation. As the intake and exhaust systems are not exposed to the atmosphere, and the system operates at a relatively low maximum temperature of less than 100° F., the transfer medium can be heated to create the vapor pressure using any one of a variety of non-polluting sources. The medium, which generates over 1076 PSI at 94° F., can be recycled and re-used many times over, resulting is low operation costs and maintenance. The engine can be configured as a piston engine of any reasonable number of cylinders depending upon desired horsepower, or as a turbine or vane type motor. The system can also be used to activate mechanisms requiring high pressure and low temperatures.

Figure 11:
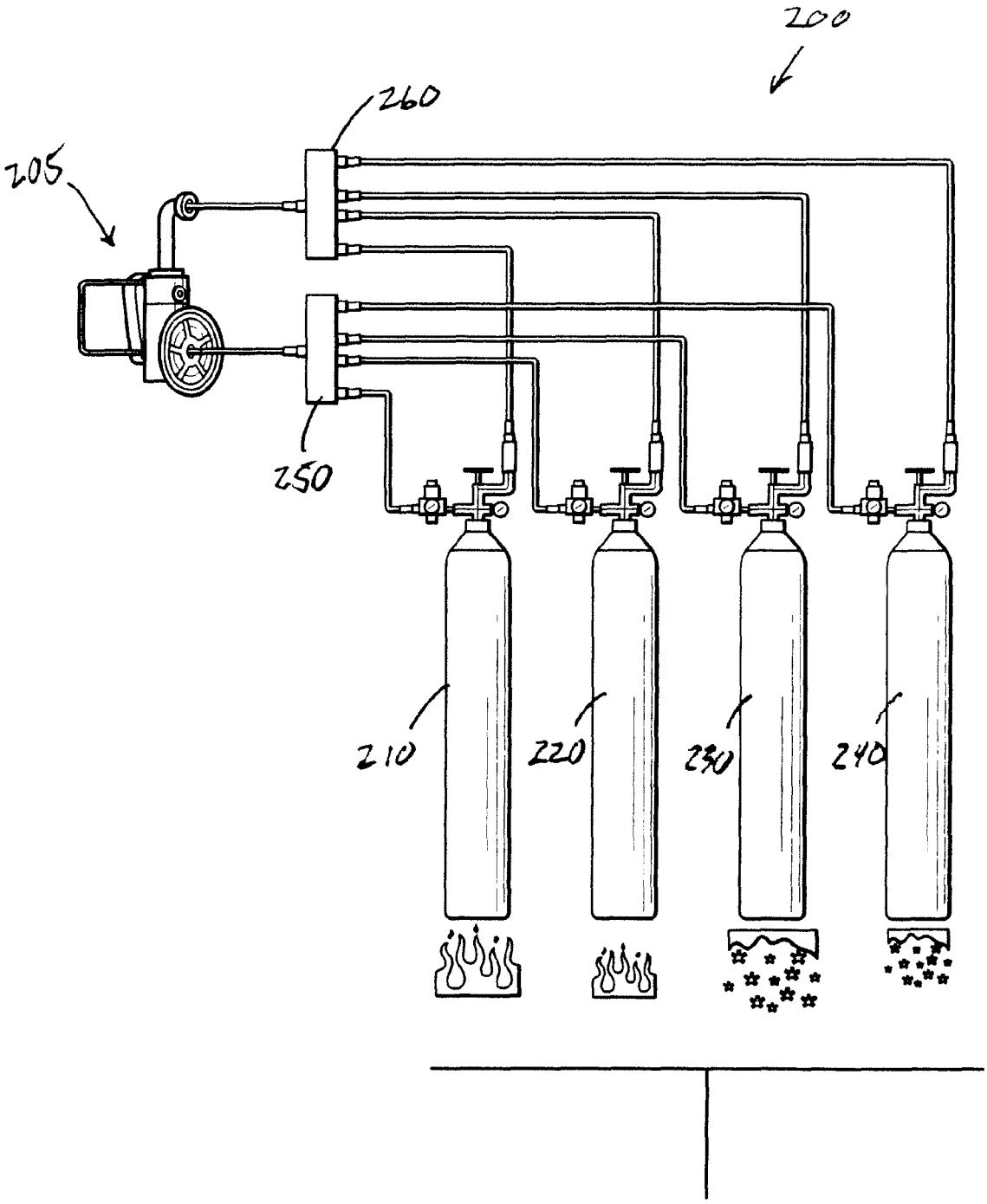
FIG. 11 is a schematic of a preferred vapor engine system according to the invention.

Another preferred system is illustrated in FIG. 11. This system 200 relates to a vapor engine 205 having a four tank supply of nitrous oxide in fluid association with the inlet and exhaust of the engine. As noted, the engine can have any number of pistons and cylinders, but for simplicity a single piston and cylinder arrangement of the type described above is shown. Four supply tanks of nitrous oxide are each connected to inlet and exhaust manifolds that include four-way valves therein. A first tank 210 is opened to supply high pressure gas to the inlet manifold 250 which in turn supplies it to the cylinder to drive the piston as previously described. After the gas expands to move the piston, the tank empties and spent gas from the piston is collected to an exhaust manifold 260 that returns the spent gas to a depleted tank. After a depleted tank is refilled with spent gas, it is heated to increase gas pressure. After pressure is restored, the supply tank is ready for re-use to again direct high pressure gas to the inlet manifold. The beauty and efficiency of this system is that while one tank 210 is delivering the high pressure gas, another one 240 has just emptied its contents, while a third tank 230 is being filled with spent gas and a fourth tank 220 which has been filled with spent gas is heated to increase and restore gas pressure to the desired value. This arrangement enables continuous operation of the engine by the manual or automatic control of the tank and manifold valves. Furthermore, the gas is retained in a closed system that recirculates the gas between the tanks and engine.

The heating of the tank that is filled with spent gas can be conducted in any way, such as by electric coils, with the electricity provided by a generator, battery or other current supply, by solar heating, by burning of a conventional fuel or even by geothermal heating. As noted above, nitrous oxide ($N_2O$) is the most preferred gas for use in this system. As the temperature required for increasing the pressure of this gas is modest, very little energy is needed for this purpose. The tank pressure is increased so that a regulated flow of 800 PSI is provided to the engine. The exhaust manifold removes spent gas at a back pressure of 500 PSI. This system allows an engine power equal to 300 PSI times the area of the piston, and a torque determined by the engine power times the stroke, so that the piston area and stroke can be selected for any desired power supply requirement.

The system can also operate as a free-standing unit that is using its own output shaft to drive the necessary accessories such as compressors, alternator pumps, and others. The addition of the auxiliary power unit relieves the main engine of these duties and allows it to transmit full developed power to the drive train and wheels. The auxiliary power unit is the equivalent of a supercharger, developing power as needed without affecting the output of the main engine. Due to the small cubic inch displacement and tremendous power output, the auxiliary unit draws little power and is primarily energized by battery power.

In the case of "medium" ambient solar temperatures, it is possible to have continuous running by adding more tanks to the system, as this enables the user to have more time between the cycles of power and refill. Thus, the number of tanks is a matter of routine selection by the skilled artisan depending upon the specific gas utilized and the desired operating pressure.

One of ordinary skill in the art can formulate various heat transfer medium mixtures that will meet and even exceed the operational criteria set forth herein. Also, other electronically controlled valves or other pressure regulating devices can be used to direct the high pressure gas into the apparatus chamber behind the piston heads. In addition, the MCU can be a microprocessor or a miniature computer. Thus, it is specifically intended that all such modifications and variations be covered by appended claims.

While the foregoing description and drawings represent a preferred embodiment of the closed-loop circuit, it will be understood that various additions, modifications and substitutions can be made therein without departing from the spirit and scope of the closed-loop circuit as defined in the accompanying claims. Therefore, it will be understood that the appended claims are intended to cover all such modifications and embodiments that come within the spirit and scope of the present invention.

What is claimed is:

1. An apparatus for generating power or torque comprising:

a first heat exchanger for heating a first heat transfer medium in a first form from a first temperature to a second higher temperature to provide an increased pressure gas, the first heat transfer medium being an expandable gas which has a boiling point below the freezing point of water;

a first mechanical device configured to use the increased pressure gas to provide mechanical energy to one or more primary components, wherein the first mechanical device produces a spent gas;

one or more additional mechanical devices configured to use the increased pressure gas to provide mechanical energy to one or more secondary components, wherein the one or more additional mechanical devices produce spent gas;

a plurality of conduits including a main conduit that initially receives the high pressure as from the first heat exchanger to direct the as in parallel to the mechanical devices and further conduits that are operably associated with the main conduit and that are sized and configured to direct the increased pressure gas to both the mechanical device and the one or more additional mechanical devices;

a pressure regulator associated with the main conduit for controlling the pressure of the increased pressure gas directed to the mechanical device and the one or more additional mechanical devices; and a conversion device operably associated with at least one of the first mechanical device and the one or more additional mechanical device, wherein the conversion device converts the spent gas to the first form for re-use.

2. The apparatus of claim 1, wherein the expandable gas has a critical temperature which is above that of the second temperature and, when heated to the second temperature, provides a pressure increase of from about 1.5 to about 5 PSI per ° F. temperature increase to provide the increased pressure gas to the main conduit.

3. The apparatus of claim 2, wherein a second higher temperature is below 125° F.

4. The apparatus of claim 1 wherein the first heat exchanger includes a vessel for containing the first heat transfer medium.

5. The apparatus of claim 4, wherein the first heat exchanger further comprises a second heat transfer medium contacting the vessel, wherein the second heat transfer medium is different from the first heat transfer medium.

6. The apparatus of claim 4, wherein the first heat exchanger further comprises at least one exchanger tube having a second heat transfer medium therein, the at least one exchanger tube operably connected to a second heat exchanger configured to heat the second heat transfer medium.

7. The apparatus of claim 6 wherein the heated second heat transfer medium moves through the at least one exchanger tube to heat the first heat transfer medium.

8. The apparatus of claim 5, wherein the first heat transfer medium is maintained in a hermetically sealed circuit so that essentially no loss of the first heat transfer medium occurs during heating, utilizing and recycling, and wherein the second heat transfer medium is heated by being operatively associated with a heating source selected from the group consisting of nuclear energy, solar energy, electric energy and combustion of fossil fuels, natural gas and hydrocarbon gas.

9. The apparatus of claim 1 further comprising a throttle or one or more valves for assisting in directing movement of the increased pressure gas to the mechanical device and the one or more additional mechanical devices, wherein the throttle or the one or more valves are either manually controlled or are electronically controlled by a controller, so that the gas can be delivered to the devices at an ideal pressure for driving same.

10. The apparatus of claim 9, wherein the first mechanical device and the one or more additional mechanical devices each comprise a plurality of components, wherein at least one of the components and the conduits are made of plastic.

11. The apparatus of claim 1, wherein the first mechanical device comprises a housing, a first piston positioned within a first chamber in the housing, a second piston positioned within a second chamber in the housing and a valve for directing the increased pressure gas between the first and second chamber.

12. The apparatus of claim 11, wherein the valve moves between a first and second position wherein, in the first position, the valve is sized and configured to allow the increased pressure gas to enter the first chamber so that the first piston moves in a first direction and, wherein, in the second position, the valve allows the increased pressure gas to enter the first chamber so that the first piston moves in a second direction.

13. The apparatus of claim 12, wherein the first and second chambers has gas positioned therein, the first mechanical device having a passageway connecting the first and second chambers so that gas positioned within the first chamber moves to the second chamber as the increased pressure gas enters the first chamber.

14. The apparatus of claim 13 further comprising an outlet which is sized and configured so that gas positioned within the second chamber moves out of the second chamber as gas moves from the first to the second chamber, the gas passing through the outlet being a lower pressure gas which is at a pressure which is lower than the pressure of the increased pressure gas.

15. The apparatus of claim 14 further comprising a compressor for receiving the lower pressure gas and increasing the pressure of the lower pressure gas.

16. The apparatus of claim 1 wherein the conversion device receives the gas from the compressor, wherein the conversion device is configure to change the gas to a liquid.

17. An apparatus for generating power or torque comprising:

a vessel for containing a heat transfer medium in a first form;

a heating source operably associated with the vessel for heating the heat transfer medium so that the medium becomes a gas at a first pressure;

a first mechanical device configured to use the gas to provide mechanical energy and produce a spent gas;

one or more additional mechanical devices configured to use the gas to provide mechanical energy to one or more components and produce spent gas;

a plurality of conduits including a main conduit that initially receives the gas from the heating source to direct the gas in parallel to the mechanical devices, and further conduits that are operably associated with the main conduit and that are sized and configured to direct the gas to both the mechanical device and the one or more additional mechanical devices;

a pressure regulator associated with the main conduit for controlling the pressure of the gas directed to the mechanical device and the one or more additional mechanical devices; and a conversion device operably associated with at least one of the first mechanical device and the one or more additional mechanical device, wherein the conversion device converts the spent gas back to the first form for re-use.

18. The apparatus of claim 17 wherein the first form is a liquid.

19. The apparatus of claim 17, wherein the gas enters the first mechanical device and additional mechanical device at the first pressure and leaves the first mechanical device and additional mechanical device at a second pressure, wherein the second pressure is less than the first pressure.

20. The apparatus of claim 19 wherein the heat transfer medium has a boiling point which is below the freezing point of water, a critical temperature which is above that of the supply temperature and a pressure which is increased by from about 1.5 to about 5 PSI per ° F. temperature increase over ambient temperature.

21. The apparatus of claim 17, wherein the first mechanical device comprises a housing, a first piston positioned within a first chamber in the housing, a second piston positioned within a second chamber in the housing, a valve and a plurality of passageways for introducing the gas into and exhausting the spent gas from each chamber.

22. The apparatus of claim 21 further comprising a control mechanism for controlling the flow of gas though the device.

23. The apparatus of claim 22, further comprising a plurality of sensors operably associated with the control mechanism.

* * * * *

UNITED STATES PATENT AND TRADEMARK OFFICE

CERTIFICATE OF CORRECTION

PATENT NO. : 7,870,735 B2
APPLICATION NO. : 11/683101
DATED : January 18, 2011
INVENTOR(S) : Romanelli et al.

It is certified that error appears in the above-identified patent and that said Letters Patent is hereby corrected as shown below:

Column 16:
Line 28, delete "as" and insert -- gas --.
Line 29, delete "as" and insert -- gas --.
Line 30, change "devices as" to -- devices, as --.

Column 18:
Line 21, after "mechanical devices; and", start a new subparagraph with "a conversion device operably".

Signed and Sealed this
Twenty-second Day of February, 2011

David J. Kappos

David J. Kappos
*Director of the United States Patent and Trademark Office*